United States Patent [19]

Shook

[11] 4,290,232

[45] Sep. 22, 1981

[54] FREIGHT CAR DOOR LOCKING MECHANISM

[75] Inventor: Jackson A. Shook, LaGrangePark, Ill.

[73] Assignee: Evans Products Company, Portland, Oreg.

[21] Appl. No.: 99,832

[22] Filed: Dec. 3, 1979

[51] Int. Cl.[3] ..... E05F 11/00; E05D 13/04

[52] U.S. Cl. ..... 49/277; 49/449; 292/DIG. 32; 292/DIG. 49

[58] Field of Search ..... 49/449, 277, 278, 276; 292/DIG. 32, DIG. 49

[56] References Cited

U.S. PATENT DOCUMENTS

| | | | |
|---|---|---|---|
| 1,241,300 | 9/1917 | Strom et al. | 49/277 |
| 1,448,135 | 3/1923 | Leist et al. | 49/277 X |
| 1,566,689 | 12/1925 | O'Connor | 49/276 X |
| 2,114,755 | 4/1938 | Wasberg | 292/DIG. 32 |

FOREIGN PATENT DOCUMENTS

| | | | |
|---|---|---|---|
| 1106639 | 5/1961 | Fed. Rep. of Germany | 49/276 |

*Primary Examiner*—Philip C. Kannan

*Attorney, Agent, or Firm*—F. Travers Burgess

[57] ABSTRACT

A locking mechanism for sliding doors, particularly of railway freight cars, has a hasp pivotally connected to a member defining an edge of the door opening, the pivotal connection being resiliently mounted on the edge defining member so as to keep the hasp under tension when the door is locked, the other end of the hasp being removably connected to the door by a manually actuable element pivoted on the door and manually swingable by means of a movable handle from locked position, in which the hasp is held in tension by a resilient connection to the door edge defining member, to an over-center unlocking position, movement of the hasp between locking and unlocking position being accommodated by the resiliency of the mounting of the hasp pivotal connection to the relatively movable member. An improved seal latch is also provided.

16 Claims, 8 Drawing Figures

FREIGHT CAR DOOR LOCKING MECHANISM

BACKGROUND OF THE INVENTION

1. Field of the Invention

The invention relates to locks for sliding doors and more particularly for locks on sliding doors of railway freight cars and the like.

2. The Prior Art

The prior art exemplified in Strom et al U.S. Pat. No. 1,241,300 and Leist U.S. Pat. No. 1,448,135 discloses locking devices comprising a hasp and an arm of a bellcrank fulcrumed on the car wall adjacent the front edge of the door, the hasp being permanently pivotally connected at one end to the door and at its other end being detachably connected to the bellcrank, e.g., in Strom et al, by a headed pin or stud received within an oversized hole in the link. In both of these prior art disclosures the operating handle is an elongated arm of the bellcrank and is swingable solely in a plane parallel to the plane of the door, with minimal lateral clearance between the operating handle and the door structure for the operator's hand.

SUMMARY OF THE INVENTION

The invention provides a sliding door locking device having a hasp pivotally mounted on structure, which may be the auxiliary door of a double sliding door arrangement, defining the front edge of the main door opening and connected to the main door by a bellcrank arm to which the hasp is removably pivotally connected. The pivotal connection of the hasp to the edge defining structure includes resilient means whereby the hasp is maintained in constant tension for keeping the front edge of the main door in tight engagement with the main door opening edge-forming member. The bellcrank has an operating handle pivoted to it to be swung outwardly from the plane of the door to provide improved clearance between the surface of the main door and the operating handle during operation of the mechanism and includes a cam arrangement for preventing rotation of the handle when the main door is closed and locked and for maintaining the handle outwardly of the main door surface to provide safe clearance between the operator's hand and the door structure during operation. An improved seal latch is also provided and is mounted on the front edge of the main door so as to fall behind the handle; that is, between the inner surface of the handle and the outer surface of the main door but in front of a locking lug on the handle so as to provide a locking condition at this point while relieving the front edge of the main door from bending stresses which might otherwise result from forcing the handle outwardly.

DETAILED DESCRIPTION OF THE INVENTION

Figure 1:
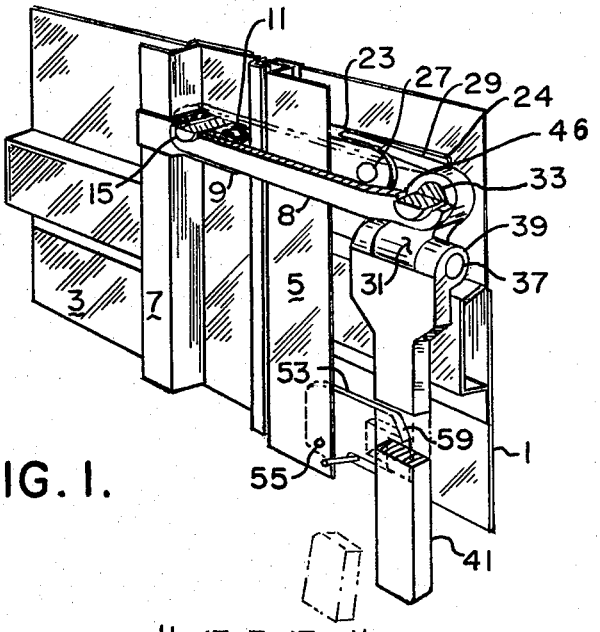
FIG. 1 is a perspective view horizontally sectioned through the hasp showing adjacent portions of the auxiliary and main doors of a double sliding door arrangement equipped with a locking mechanism constructed in accordance with the invention.
Figure 3:
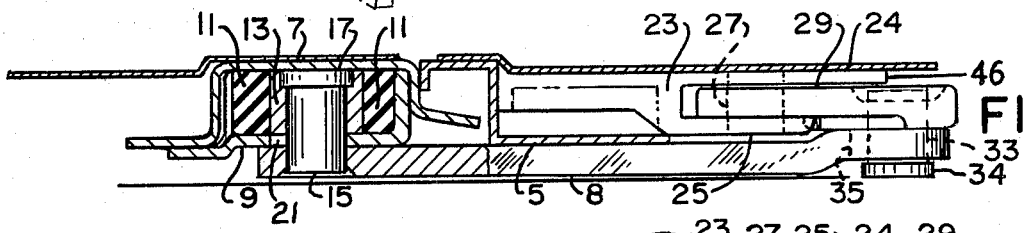
FIG. 3 is a top view of the locking mechanism partially horizontally sectioned along line 3—3 of FIG. 2.

The numerals 1 and 3 refer respectively to main and auxiliary doors forming double sliding door arrangement frequently applied to railway box cars. Doors 1 and 3 are formed respectively with framing including adjacent vertical frame members 5 and 7 arranged for abutting edge-to-edge relationship when both doors are closed, as may be best seen in FIGS. 1 and 3. The locking mechanism includes a hasp 8 formed with an inwardly extending pin 15 inwardly headed at 17. Vertical frame member 7 is of outwardly open channel section and contains a pivot assembly comprising an inwardly open housing 9 in which is mounted an elastomeric block 11 surrounding a bushing 13. Pin 15 passes through an enlarged opening 21 in the outer wall of housing 9 and is rotatably mounted in bushing 13. Hasp 8 is thus rotatable about the axis of pin 15 and is movable horizontally in a direction parallel to the door by the yieldability of elastomeric block 11, the resiliency of which opposes but does not prevent such movement of pin 15 and hasp 8.

Figure 2:
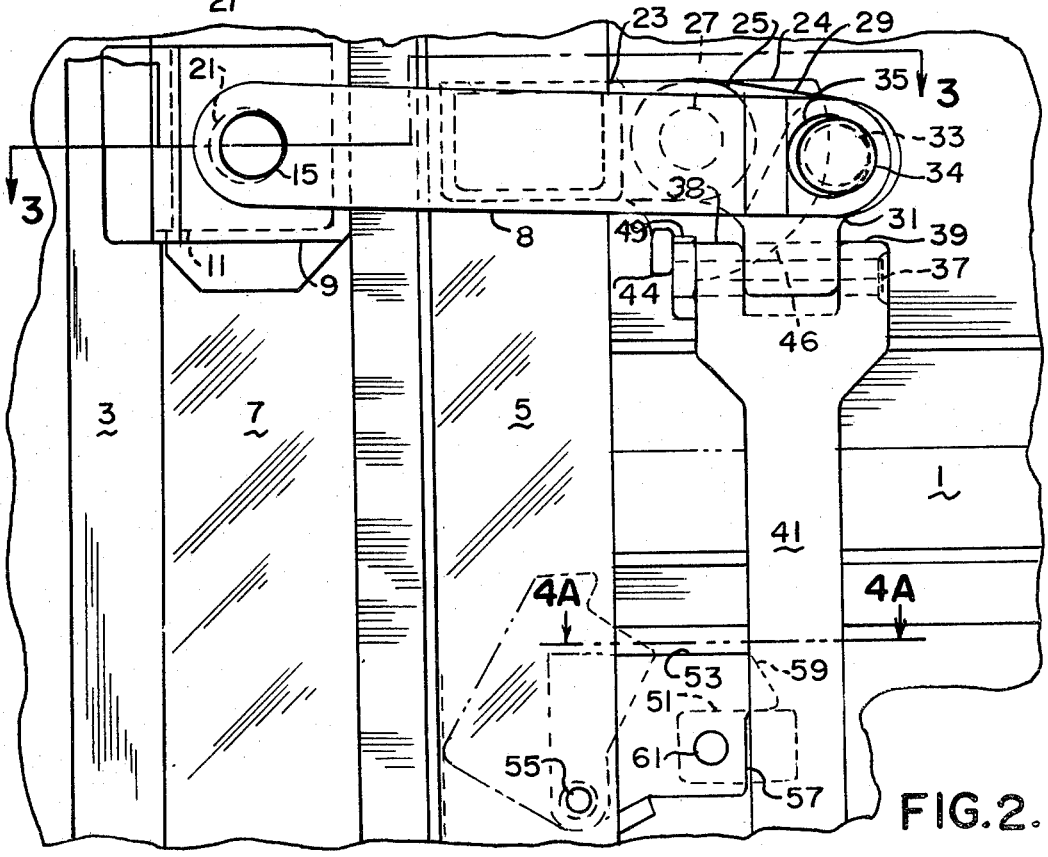
FIG. 2 is a side elevational view of the locking mechanism in the locked position showing adjacent portions of the auxiliary and main doors.
Figure 4:
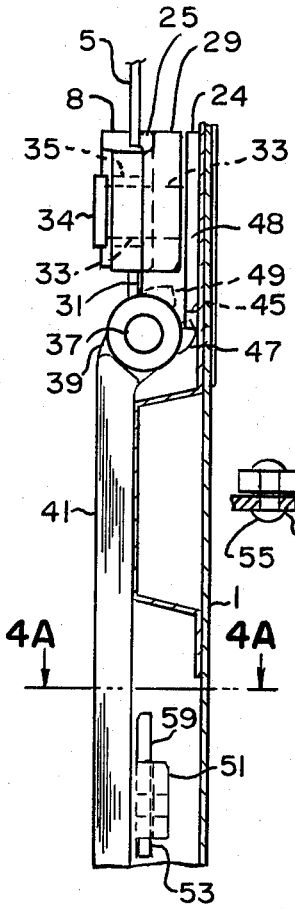
FIG. 4 is a transverse sectional view through the main door showing the locking mechanism.
Figure 4A:
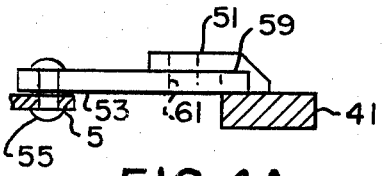
FIG. 4A is a horizontal sectional view along lines 4A—4A of FIGS. 2 and 4.
Figure 6:
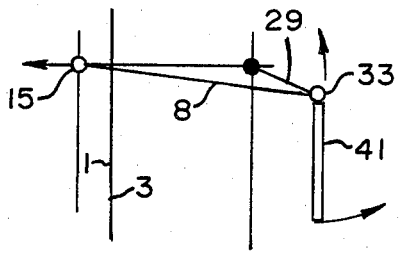
FIGS. 6 and 7 are schematic side elevational views respectively showing the locking mechanism parts in their locking and unlocked positions.
Figure 7:
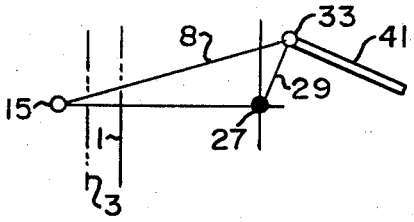

Main door 1 rigidly mounts in engagement with its front vertical end frame member 5 a fulcrum member 23 extending rearwardly from the vertical frame member 5 and having a base plate 24 abutting the front surface of the door and an outer plate 25 defining with base plate 24 a rearwardly open clevis formed with transversely aligned holes 28 at the same level as pin 15 on auxiliary door 3. An arm 29 of a bellcrank member is pivotally mounted within clevis 24, 25 by pin 27 and extends rearwardly therefrom. Adjacent its rear end, arm 29 mounts an outwardly extending headed stud or pin 33 and the rear end of hasp 8, formed with a circular hole 35 slightly larger than head 34 of pin 33, is pivotally connected by pin 33 to the rear end of bellcrank arm 29. The spacing of pin 33 from the front edge of main door 1 is such that elastomeric block 11 is under compression rearwardly of bushing 13 and acts through bushing 13 on pin 15 to maintain hasp 8 in tension when the parts are in the locking position shown in FIGS. 1 and 2 and schematically in FIG. 6, in which the axis of hasp 8 passes slightly below the center of fulcrum pin 27 of bellcrank arm 29. With the conditions described above and the parts in the positions shown in FIGS. 1 and 2, since hasp 8 is in tension, end framing members 5 and 7 of the respective main and auxiliary doors are held in tightly abutting relation. In order to release the locked relation between doors 1 and 3, it is necessary that arm 29 be rotated counterclockwise about its fulcrum 27 from the position schematically shown in FIG. 6 to the over-center position of the link shown schematically in FIG. 7.

Figure 5:
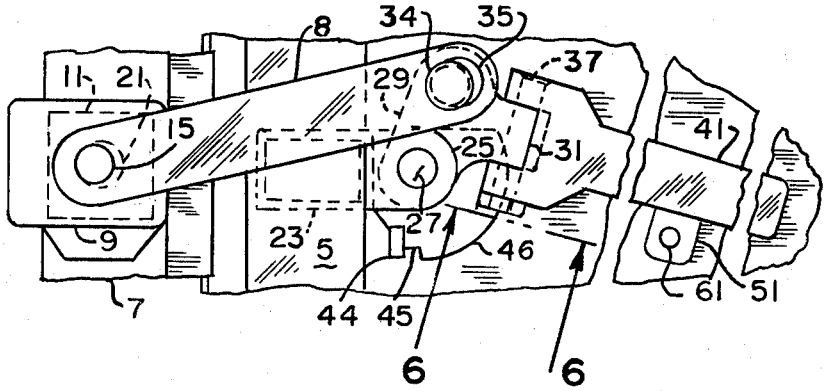
FIG. 5 is a partial side elevational view of the locking mechanism corresponding to FIG. 2 but showing the parts in unlocked positions.

For the purpose of selectively holding bellcrank arm 29 in the locked position of FIGS. 1-3 and 6 and moving it to the released position of FIG. 5, the bellcrank including arm 29 has a short vertical arm 31 depending from arm 29 and mounting a horizontal pin 37, the arm of which is parallel to the door. On the protruding ends of pin 37 are mounted upwardly extending bifurcations 38 and 39 of an elongated handle member 41. For locking the bellcrank 29, 31 in locked position, fulcrum element base plate 24 extends downwardly to a level lower than the top of handle bifurcations 38 and 39 and is formed with a downwardly open notch 45, in which an inwardly directed radial lug 47 on handle bifurcation 38 is received when the door is locked and the handle is in vertical locking position. The lower and rear edge of fulcrum element base plate is in the form of a quadrant 46 concentric with fulcrum pin 27.

In order to release the lock, the handle must be swung outwardly about its pivot pin 37 so that its lower end is spaced outwardly a substantial distance from the door surface sufficient for the operator to swing the handle counterclockwise and keep his hand completely clear of the door structure. For limiting the outward swinging of the handle, a second upper lug 49 is formed on handle bifurcation 38 for engagement with the outer surface of quadrant 46 when the maximum outwardly swung position of the handle is reached. At the same time, after swinging of the handle in a direction generally parallel to the surface of the door to release the lock is commenced, handle projection 47 is out of registry with notch 45 and also engages the outer surface of quadrant 46 to maintain the handle in its outwardly swung position during its movement by the operator between door locked and door unlocked positions.

With the arrangement as described above, handle 41 may be swung outwardly about its supporting pivot pin 37 until projection 49 engages fulcrum element base plate 24 and projection 47 is out of notch 45 and then swung counterclockwise about bellcrank fulcrum pin 27. During this movement from the locked position shown in FIG. 6 to the over-center unlocked position shown in FIG. 7 yieldability of elastomeric block 11 will facilitate the movement past the center position in which pins 15, 27 and 33 are in alignment with each other to the over-center unlocked position of FIG. 7 in which the hasp 8 has pushed the auxiliary door and main door away from each other and is no longer under tension, such that the rear end of hasp 8 can be lifted off of headed pin 33 and the doors 20 released thereby for movement as desired to open positions.

A seal latch arrangement comprises a lug 51 mounted on the inner surface of handle 41, lug 51 being of generally L-shape in plan with one of its legs extending forwardly from the front edge of the handle toward the front edge of the door and being offset inwardly from the inner surface of the handle the length of its other leg. A latch plate 53 is pivoted at 55 to the inner surface of the door front end frame member 5 and is of generally rectangular shape and of a size that, when it is swung to the horizontal latching position as shown in solid lines in FIG. 2, its rear vertical edge 57 is in closely spaced parallel relation with the front edge of handle 41. The upper portion of the rear edge of plate 53 is nose-shaped, as at 59, such that it extends rearwardly inwardly of handle 41 and rests on the top of the inward leg of L-shaped lug 51 while the body of plate 53 outwardly abuts the outer surface of the forwardly extending leg of lug 51. Lug 51 and latch plate 53 are formed with registering holes 61 to receive the usual car seal. From the foregoing it will be seen that handle 41 cannot be swung outwardly from the locked position, to initiate unlocking of the door, without breaking the seal. If it is desired to open the door, the seal can be broken and plate 53 swung counterclockwise to the broken line position shown in FIG. 2, thus freeing the handle 41 to be swung outwardly away from the plane of the door to free lug 47 from notch 45 in quadrant 48 and thus permit swinging of the handle and associated parts of the mechanism toward the unlocked position.

The details of the locking mechanism disclosed herein may be varied substantially without departing from the spirit of the invention and the exclusive use of such modifications as come within the scope of the appended claims is contemplated.

I claim:

1. In combination with a pair of members, at least one of which is a sliding door, said members having opposed vertical edges and being relatively movable from a closed position wherein their vertical edges abuttingly engage each other and open position wherein their vertical edges are spaced from each other, a locking device comprising a hasp, means pivotally mounting said hasp on one of said members, resilient means biasing said pivotal mounting means away from the edge of said one member, an arm pivoted on a transverse axis to said other member and extending away from the edge of said other member, the free end of said hasp being removably pivoted to the free end of said arm, and means for holding said arm in slight disalignment with said hasp when said door is fully closed, said resilient means then maintaining said hasp in tension and the abutting edges of said members in tightly engaged relation, said arm being swingable about its pivotal mounting on said other structure to an over-center position with respect to said hasp, whereby said hasp is placed under compression to move the edges of said members away from each other and permit detachment of said hasp from its pivotal connection to said arm to accommodate further separation of said members.

2. The combination according to claim 1 wherein both of said members are sliding doors.

3. The combination according to claim 1 wherein said resilient biasing means comprises an elastomeric block mounted on said one member and restrained against movement longitudinally of said one member toward said other member.

4. The combination according to claim 3 including a housing confining said elastomeric block in a fixed position on said one member, a bushing surrounded by said block and a pin rotatably mounted in said bushing and held therein against axial movement, said pin being rigidly secured to said hasp.

5. The combination according to claim 4 wherein said block and bushing are wholly within said housing and said housing is formed with an opening having a greater dimension than the diameter of said pin, said pin projecting outwardly through said opening to its connection with said hasp.

6. The combination according to claim 1, wherein said means for rotating said arm about its pivot comprises a second arm connected to said first-named arm to form a bellcrank.

7. The combination according to claim 6, wherein an elongated handle is pivoted to said second arm on an axis parallel to the general plane of said members, whereby for operation of the locking device between locked and unlocked positions said handle is swingable about said pivot laterally away from said other member to provide lateral clearance for the hand of an operator between said handle and said other member during operation of said locking mechanism.

8. The combination according to claim 7 wherein a fulcrum forming element comprises a plate fixed on said other member, said arm being pivoted directly to said plate, said plate and said handle having first co-operating elements preventing swinging of said handle in a door locking direction beyond the door-locked position, second co-operating elements for selectively holding the handle in door-locked position, and third co-operating elements holding the handle in its laterally outward operating position whenever the handle is swung away from the bellcrank fulcrum away from the door-locked position.

9. The combination according to claim 8 wherein said first co-operating elements comprise a projecting lug on said plate and an opposed surface on said handle abuttingly engageable when the handle is in its door-locked position.

10. The combination according to claim 9 wherein said second co-operating elements comprise a recess in said plate and a lug on said handle receivable in said recess when the handle is in locked position.

11. The combination according to claim 10 wherein said third co-operating elements comprise a portion of the outer surface of said plate and a second lug on said handle slidably engageable therewith when said handle is out of the locked position.

12. The combination according to claim 7, wherein said handle and said other member have co-operating elements holding said handle and bellcrank in door-locked position when said handle is parallel to the plane of said other member and for holding said handle in its laterally outward position whenever said handle is swung about the bellcrank arm pivot away from the door-locked position.

13. The combination according to claim 12, wherein said door and said handle have co-operating stop means preventing swinging of said handle in a locking direction beyond the door locked position.

14. The combination according to claim 13, including a seal latch arrangement comprising a plate pivoted on said other member on an axis normal to the general plane thereof, said handle being formed with a lug extending laterally inwardly therefrom toward said other member and thence parallel to the plane of said other member toward the vertical edge thereof, said latch plate being swingable to a position laterlly outward of the parallel portion of said lug and having an upper rearwardly offset portion adapted to overlie the laterally inwardly directed portion of said lug and abuttingly engage the laterally inward surface of said handle, said latch plate and said lug having apertures alignable when the mechanism is in locked position to receive the usual car door seal.

15. The combination according to claim 12, wherein said door mounts a plate on its surface, said co-operating elements holding the parts in door-locked position includes a notch in the periphery of said plate and a lug on said handle received in said notch when the mechanism is locked and the handle is in its inward position and removable from said notch when said handle is swung outwardly.

16. The combination according to claim 15, wherein said co-operating elements holding said handle in its laterally outward position comprise a second lug on said handle slidably engageable with the outer surface of said plate.

* * * * *